United States Patent [19]

Ushida et al.

[11] Patent Number: 4,869,216

[45] Date of Patent: Sep. 26, 1989

[54] IGNITION DISTRIBUTOR FOR INTERNAL COMBUSTION ENGINE

[75] Inventors: Masayasu Ushida, Chiryu; Sigeru Nakao, Toyota; Kyo Hattori, Aichi, all of Japan

[73] Assignees: Nippondenso Co., Ltd., Kariya; Toyota Jidosha Kabushiki Kaisha, Toyota, both of Japan

[21] Appl. No.: 215,786

[22] Filed: Jul. 6, 1988

[30] Foreign Application Priority Data

Jul. 6, 1987 [JP] Japan ..... 62-168447
May 26, 1988 [JP] Japan ..... 63-129091

[51] Int. Cl.[4] ..... F02P 7/02
[52] U.S. Cl. ..... 123/146.5 A; 123/195 A
[58] Field of Search ..... 123/146.5 A, 195 A; 200/19 R, 19 A, 19 DC

[56]. References Cited

U.S. PATENT DOCUMENTS

| | | | |
|---|---|---|---|
| 4,305,352 | 12/1981 | Oshima et al. | 123/146.5 A |
| 4,454,856 | 6/1984 | Fox et al. | 123/146.5 A |
| 4,470,384 | 9/1984 | Umemura | 123/146.5 A |
| 4,545,340 | 10/1985 | Schreiner | 123/146.5 A |
| 4,597,366 | 7/1986 | Chen | 123/146.5 A |
| 4,619,227 | 10/1988 | Kapfer et al. | 123/146.5 A |
| 4,620,513 | 11/1988 | Ushida et al. | 123/146.5 A |
| 4,640,239 | 2/1987 | Green | 123/146.5 A |

FOREIGN PATENT DOCUMENTS 0176471 3/1983 Japan .

*Primary Examiner*—Willis R. Wolfe
*Attorney, Agent, or Firm*—Cushman, Darby & Cushman

[57] ABSTRACT

An ignition distributor includes a distributor housing having a cup-shaped cylindrical partition wall accommodated in an annular recess of a driven pulley mounted on an end portion of a camshaft, the partition wall having an annular bottom portion arranged in the annular recess to provide a circular opening, a distributor rotor of generally cylindrical shape fixed to the end portion of the camshaft and housed within the partition wall, the rotor having an annular flange formed at its outer periphery with an annular rim which is opposed to the annular bottom portion of the partition wall to form a first annular passage, and a distributor cap coupled with an open end of the partition wall to cover the rotor, the cap having a cylindrical extension wall extending therefrom into the interior of the partition wall and being arranged concentrically with the partition wall to form an annular space in communication with the first annular passage and a rotor space in which the rotor is arranged. The extension wall of the cap having an inner end slightly spaced from the annular rim of the rotor flange to form a second annular passage for communication between the annular and rotor spaces. The annular space is communicated with a source of negative pressure to discharge the air therefrom, while the rotor space is communicated with the atmospheric air to introduce fresh air thereinto.

10 Claims, 5 Drawing Sheets

IGNITION DISTRIBUTOR FOR INTERNAL COMBUSTION ENGINE

BACKGROUND OF THE INVENTION

1. Field of the Invention

The present invention relates to an ignition distributor for an internal combustion engine, and more particularly to an ignition distributor of the type which includes a distributor rotor coaxially fixed to an end portion of a camshaft extending outwardly from a cylinder head of the engine.

2. Description of the Prior Art

In Japanese Patent Early Publication Nos. 58-176471 and 61-1872, there has been proposed an ignition distributor whose housing is composed of a distributor housing and of a distributor cap fixedly coupled thereon, wherein the distributor housing is fastened to an engine block to cover a timing belt stretched over a driven pully mounted on an end portion of a camshaft extending outwardly from the engine block, the distributor housing having an end wall formed therein with a circular opening through which a distributor rotor is inserted and fixed to the end portion of the camshaft coaxially therewith, and wherein the distributor cap is detachably coupled with the end wall of the distributor housing to cover the distributor rotor. In such an arrangement of the ignition distributor, an annular space around the distributor rotor is formed as narrow as possible to protect the timing belt from ozone gas entering into the distributor housing from the rotor space and to protect the distributor rotor from dust particles entering into the rotor space from the distributor housing. However, the annular space is in a simple form. For this reason, it is difficult to prevent the entry of ozone gas into the distributor housing or the entry of dust particles into the rotor space. In an attempt to solve the problem, it has been proposed to dispose a seal member in the annular space. In such a case, the assembly of the distributor rotor with the camshaft becomes difficult due to the presence of the seal member.

SUMMARY OF THE INVENTION

It is, therefore, an object of the present invention to provide an improved ignition distributor capable of reliably protecting the timing belt from the ozone gas and of reliably protecting the distributor rotor from the dust particles without causing any difficulty in assembly processes of the components.

According to the present invention, the object is attained by providing an ignition distributor for an internal combustion engine having a camshaft rotatably mounted within a cylinder head of the engine and a driven pulley mounted on an end portion of the camshaft extending outwardly from the cylinder head to be driven by a crankshaft of the engine. The ignition distributor comprises a distributor housing fastened to the cylinder head and having a cup-shaped cylindrical partition wall accomodated in an annular recess of the driven pulley concentrically with a central longitudinal axis of the camshaft, the partition wall having an open end and an annular bottom portion arranged in the annular recess of the pulley to provide a circular opening concentric with the central longitudinal axis of the camshaft, a distributor rotor of generally cylindrical shape fixed to the end portion of the camshaft coaxially therewith and housed in an interior of the partition wall, the rotor having an annular flange formed at its outer periphery with an annular rim which is opposed to the annular bottom portion of the partition wall to form a first annular passage, and a distributor cap coupled with the open end of the partition wall to cover the rotor.

The distributor cap has a cylindrical extension wall extending therefrom into the interior of the partition wall and being arranged concentrically with the partition wall to form an annular space in communication with the first annular passage and a rotor space in which the rotor is arranged. The extension wall of the cap has an inner end slightly spaced from the annular rim of the rotor flange to form a second annular passage for communication between the annular and rotor spaces. The annular space is communicated with a source of negative pressure or the atmosphere air to discharge the air therefrom, while the rotor space is communicated with the atmosphere air to introduce fresh air thereinto.

In a practical embodiment of the present invention, it is preferable that the distributor rotor is integrally formed at its outer periphery with a plurality of circumferentially spaced ribs which causes the air in the rotor space to flow radially outwardly toward the second annular passage during rotation of the camshaft. It is also preferable that the annular rim of the rotor flange is integrally formed with a plurality of circumferentially spaced blades which are opposed to the annular bottom portion of the partition wall to forcibly cause the flow of air toward the first annular passage during rotation of the camshaft.

BRIEF DESCRIPTION OF THE DRAWINGS

Other objects, novel features and advantages of the present invention will be more readily appreciated from the following detailed description of preferred embodiments thereof when considered with reference to the accompanying drawings, in which.

DESCRIPTION OF THE PREFERRED EMBODIMENTS

Figure 1:
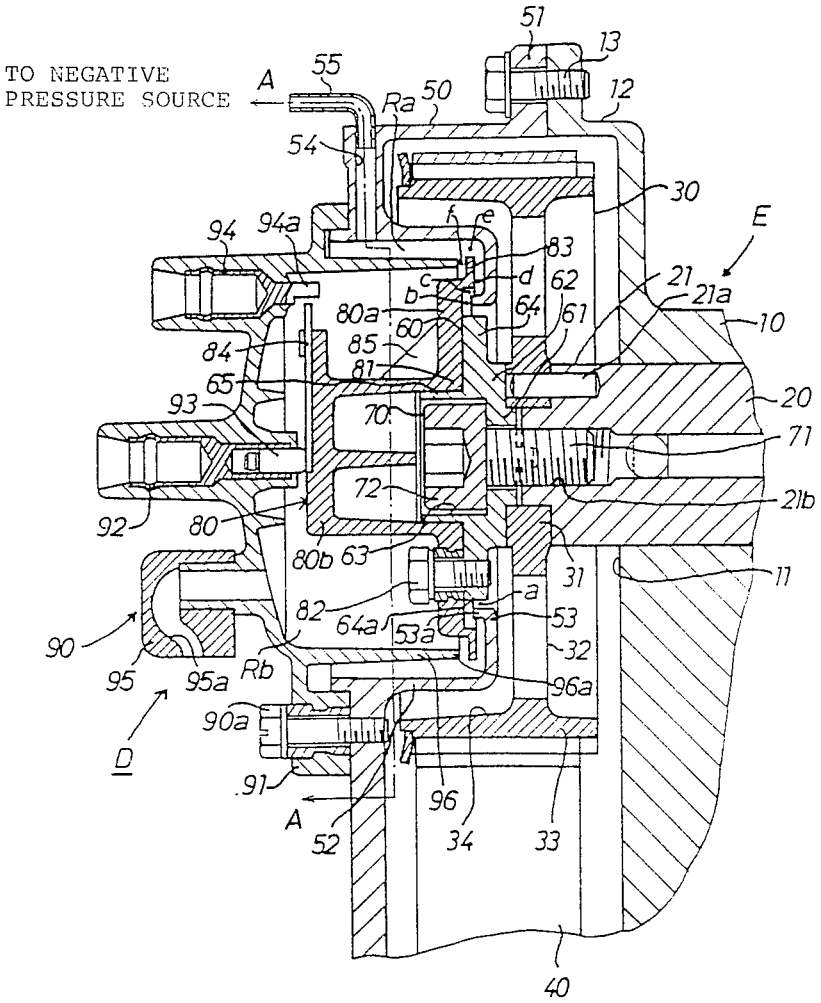
FIG. 1 illustrates a longitudinal section of an ignition distributor in accordance with the present invention.

Referring to the drawings, an ignition distributor D shown in FIG. 1 is mounted on a camshaft 20 of an internal combustion engine E. The camshaft 20 is rotatably mounted within a cylinder head 10 of the engine and is arranged in parallel with a crankshaft (not shown) of the engine. A driver pulley 30 is coupled at its hub portion 31 with a stepped end portion 21 of camshaft 20 extending outwardly from the side wall 11 of cylinder head 10 and is fixed to the camshaft 20 by means of a knock pin 21*a* for rotation therewith. The driven pulley 30 has a plurality of spokes 32 extending radially outwardly from its hub portion 31 and a cylindrical toothed-belt wheel 33 integral with spokes 32. A timing belt 40 is stretched over the driven pulley 30 and a drive pulley (not shown) mounted on an end portion of the crankshaft to transmit the rotation of the crankshaft to the camshaft 20.

A housing 50 is formed to contain therein the driven pulley 30 and timing belt 40 together with the drive pulley on the crankshaft. The housing 50 has an outer peripheral flange 5 fitted to a corresponding outer peripheral flange 12 integral with the side wall 11 of cylinder head 10 and fastened to each other by means of screws 13. The housing 50 is integrally formed with a distributor housing in the form of a cup-shaped cylindrical partition wall 52 which is accomodated in an annular recess 34 of driven pulley 30 concentrically with the central longitudinal axis of camshaft 20. The cylindrical partition wall 52 has an annular bottom portion 53 formed at its inner periphery with an axially outwardly protruded annular rim **53*a* which forms a circular opening concentric with the central longitudinal axis of camshaft 20**.

The ignition distributor D comprises an annular stepped adapter 60 which is inserted through the opening of partition wall 52 into an interior of housing 50 and fixed to the end portion 21 of camshaft 20 by means of a fastening bolt 70. The adapter 60 has a stepped portion 61 of small diameter coaxially coupled within the hub portion 31 of pulley 30, a stepped portion 62 of intermediate diameter fitted to an outside end face of hub portion 31, and an annular flange 64 of large diameter spaced at its outer periphery from the internal annular rim **53*a* of partition wall 52 to form an annular passage a. The fastening bolt 70 has a male screw part 71 threaded into a female screw part 21*b* in the end portion 21 of camshaft 20 and a head part 72 accomodated in a stepped bore 63 of adapter 60**.

Figure 2:
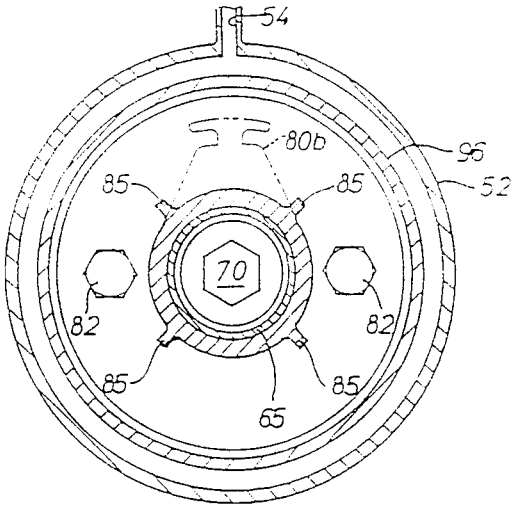
FIG. 2 is a cross-sectional view taken along line A—A in FIG. 1.

The ignition distributor D comprises a rotor 80 of generally cylindrical shape coupled at its hollow portion 81 with a cylindrical boss 65 of adapter 60 and housed in the interior of partition wall 52 coaxially with the camshaft 20. The rotor has an annular flange **80*a* fitted to the annular flange 64 of adapter 60 and fixed thereto by means of screws 82. The annular flange 80*a* of rotor 80 is formed at its outer periphery with an annular rim 83 which is opposed to the annular rim 53*a* and bottom portion 53 of partition wall 52 to form annular passages b, c and d in communication with the annular passage a. The rotor 80 has a head portion 80*b* on which is securely mounted a distributor terminal plate 84 in a radial direction. As shown in FIGS. 1 and 2, the rotor 80 is further formed at its outer periphery with a plurality of circumferentially spaced radial ribs 85 which extend from annular flange 80*a* at an inclined angle to occur radial flow of the air in the interior of partition wall 52 during rotation of the rotor 80**.

A distributor cap 90 is coupled over an annular open end of partition wall 52 to cover the rotor 80. The distributor cap 90 has an outer peripheral flange 91 coupled over the annular open end of partition wall 52 and fixed to the side wall of housing 50 by means of fastening bolts **90*a*. A stationary electrode 92 is secured in a head portion of distributor cap 90 to support a movable center electrode 93 in its internal hollow end. The movable electrode 93 is resiliently in contact with the distributor terminal plate 84 under load of a coil spring (not shown) acting thereon. A plurality of circumferentially spaced stationary electrodes 94 are secured in the distributor cap 90 in surrounding relationship with the center stationary electrode 92 in such a manner that each inner end 94*a* of electrodes 94 is opposed to an end face of distributor terminal plate 84** with a slight clearance.

The distributor cap 90 is provided thereon with an inlet plug 95 in which a vent passage **95*a* is formed to permit the flow of fresh air passing therethrough into the interior of cap 90. The distributor cap 90 is integrally formed with a cylindrical extension wall 96 which extends from its head portion into the interior of partition wall 52. The cylindrical extension wall 96 of cap 90 is arranged concentrically with the partition wall 52 to subdivide the interior of partition wall-52 into an annular space Ra and a rotor space Rb. In this arrangement, an inner end 96*a* of the cylindrical extension wall 96 is slightly spaced from the annular rim 83 of rotor flange 80*a* to form an annular passage f for communication between the annular and rotor spaces Ra and Rb. The annular passage f is further communicated with the annular passage d through an annular passage e around the annular rim 83 of rotor flange 80*a*. Thus, a labyrinth is formed by the annular passages a, b, c, d, e and f between the interior of housing 50 and the rotor space Rb. In addition, the annular space Ra is formed larger in radial width than each axial width of annular passages d and f to eliminate the occurrence of turbulence therein. The annular space Ra is in open communication with a through hole 54 in the side wall of housing 50 which is connected to a source of negative pressure by means of a connecting pipe 55**. In a practical embodiment, the source of negative pressure is obtained at an intake manifold of the engine.

In operation, the camshaft 20 is driven by the crankshaft of the engine E through the timing belt 40 to rotate the rotor 80, and in turn, the distributor terminal plate 84 rotating in unison with the rotor 80 applies a high voltage produced by an ignition coil at the rhythm of the ignition sequence to the circumferential electrodes 94 from the center electrodes 92, 93. During rotation of the rotor 80, the circumferential ribs 85 of rotor 80 causes the air in rotor space Rb to flow radially outwardly toward the annular passage f and causes suction of the fresh air into the rotor space Rb from the inlet plug 95. In this instance, the vent passage **95*a* of inlet plug 95 permits only the fresh air passing therethrough into the rotor space Rb. On the other hand, rotation of the adapter 60 causes the air in housing 50 to flow into the annular space Ra through the annular passages a, b, c, d and e. Thus, the air from rotor space Rb is mixed with the air from housing 50 in the annular space Ra and is sucked by the negative pressure applied thereto to be discharged out of the annular space Ra through the passage 54 and connecting pipe 55**.

During rotation of the camshaft 20 described above, ozone gas will occur in the rotor space Rb due to the arc formation during the interruption of the high voltage current, and dust particles will occur in housing 50 due defacement of the timing belt 40. The ozone gas is, however, conveyed by the radial flow of air in rotor space Rb into the annular space Ra through passage f, while the dust particles are conveyed by the flow of air in housing 50 into the annular space Ra through passages a, b, c, d and e. In this instance, the annular rim 83 of rotor flange **80*a* acts to separate the flow of ozone gas from the flow of dust particles, and the negative pressure is applied to the ozone gas and dust particles through the connecting pipe 55 to discharge them out of the annular space Ra. Thus, the timing belt 40 is protected from the ozone gas entering into the interior of housing 50 from the rotor space Ra, while the rotor 80 is protected from the dust particles entering into the rotor space Rb from the housing 50**.

Figure 3:
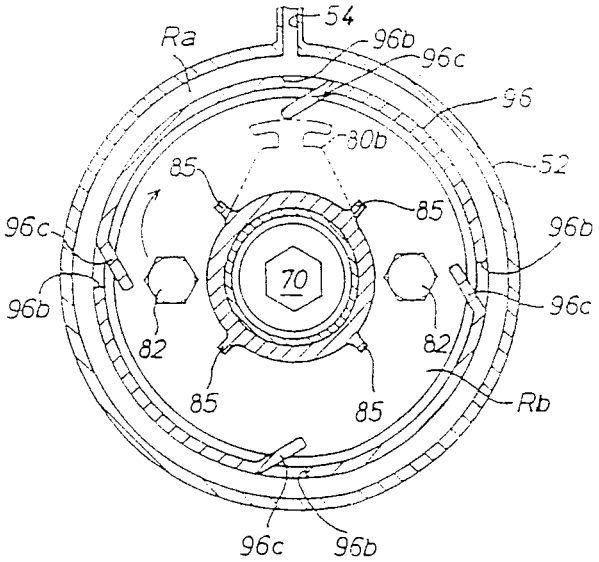
FIG. 3 is a cross-sectional view of a modification of the part shown in FIG. 2.

In the above arrangement, it is advantageous that the ignition distributor D can be mounted on the end portion of camshaft 20 in a compact construction since the housing partition wall 52 is accomodated in the annular recess 34 of driven pulley 30 to contain the rotor 80 therein. Furthermore, in a practical embodiment of the present invention, it is desirable that as shown in FIG. 3, the cylindrical extension wall 96 of distributor cap 90 is cut out at its periphery in such a manner as to form a plurality of circumferentially spaced openings **96*b* and to form a plurality of radially inwardly inclined lugs 96*c*. In the case that the rotor 80 is arranged to rotate in a direction shown by an arrow in FIG. 3, the inclined lugs 96*c* of extension wall 96 serve to discharge through the openings 96*b*** the ozone gas with the radial flow of air from the rotor space Rb into the annular space Ra as rapidly as possible.

Figure 5:
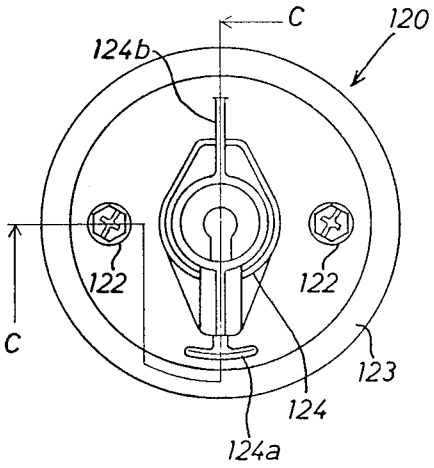
FIG. 5 is a front view of the ignition distributor shown by an arrow B in FIG. 4.
Figure 4:
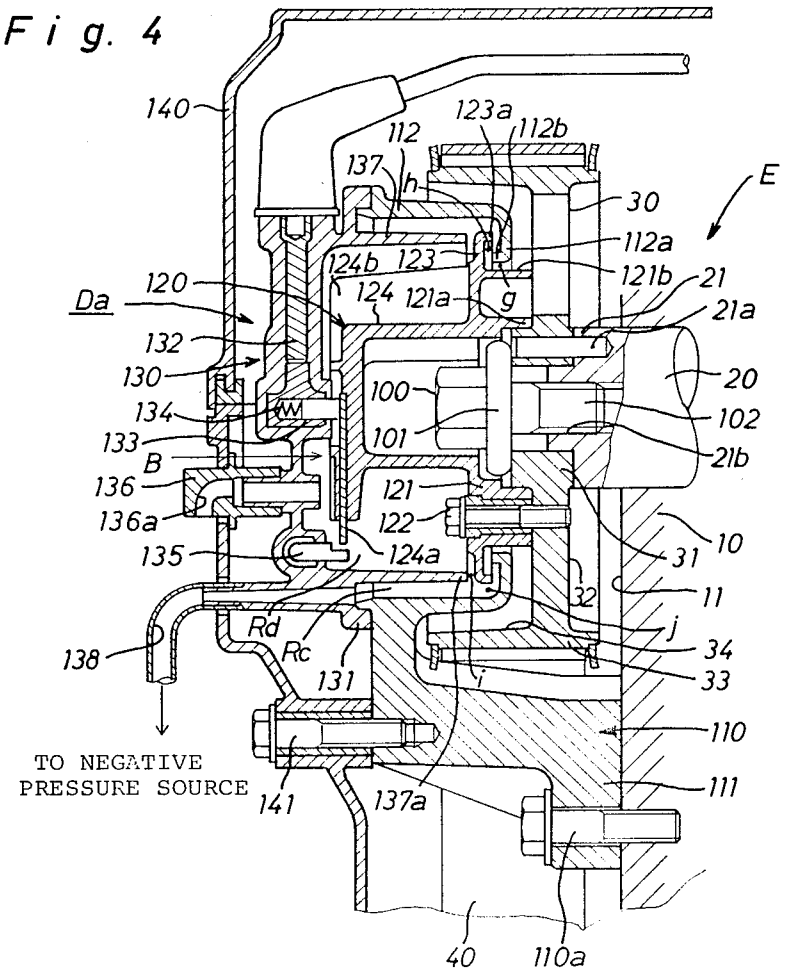
FIG. 4 illustrates a longitudinal section of another embodiment of the ignition distributor, taken along line C—C in FIG. 5.

In FIGS. 4 and 5 there is illustrated another embodiment of the present invention wherein a flanged bolt 100 is threaded into the end portion of camshaft 20 to fasten the driven pulley 30 in place, and wherein a distributor housing 110 is fitted to the side wall 11 of cylinder head 10 and fixed thereto by means of a fastening bolt **110*a*. The flanged bolt 100 has an annular flange 101 engaged with the hub portion 31 of driven pulley 30 and a male screw portion 102 threaded into the female screw portion 21 in camshaft 20. The distributor housing 110 has a leg portion 111 fixed to the side wall of cylinder head 10 and a cup-shaped cylindrical partition wall 112 carried by the leg portion 111 and accomodated in the annular recess 34 of driven pulley 30 concentrically with the central longitudinal axis of camshaft 20. The cylindrical partition wall 112 has an annular bottom portion 112*a* formed at its inner periphery with an axially outwardly protruded annular rim 112*b* which forms a circular opening concentric with the central longitudinal axis of camshaft 20**.

The ignition distributor Da of FIG. 4 comprises a rotor 120 of generally cylindrical shape coaxially fixed to the camshaft 20 and housed in the interior of partition wall 112. The rotor 120 has an annular flange 121 coupled at **121*a* with the hub portion 31 of driven pulley 30 and fixed to the spokes 32 of pulley 30 by means of screws 122. The annular flange 121 of rotor 120 has an outer peripheral surface 121*b* surrounded by the annular rim 112*b* of partition wall 112 to form an annular passage g. The annular flange 121 of rotor 120 is formed at its outer periphery with an annular rim 123 which is opposed to the bottom portion 112*a* and annular rim 112*b* of partition wall 112 to form an annular passage h in communication with the annular passage g. The rotor 120 has a head portion 124 on which is securely mounted a distributor terminal plate 124*a* in a radial direction. As shown in FIGS. 4 and 5, the rotor 120 is further formed at its outer periphery with a pair of radial ribs 124*b* which are arranged to occur radial flow of the air in the interior of partition wall 112 during rotation of the rotor 120**.

A distributor cap 130 is coupled over an annular open end of partition wall 112 to cover the rotor 120. The distributor cap 130 has an outer peripheral flange 131 coupled over the annular open end of partition wall 112 and fixed to the side wall of distributor housing 110 by means of fastening bolts (not shown). The distributor cap 130 has a thick wall provided therein with a stationary electrode 132 and a movable center electrode 133. The center electrode 133 is electrically connected at its one end to the stationary electrode 132 and is resiliently in contact at its other end with the distributor terminal plate **124*a* under load of a coil spring 134 acting thereon. A plurality of circumferentially spaced stationary electrodes 135 are secured in the distributor cap 130 in surrounding relationship with the center electrode 133 in such a manner that each inner end of electrodes 135 is opposed to an end face of distributor terminal plate 124*a*** with a slight clearance.

The distributor cap 130 is provided thereon with an inlet plug 136 in which a vent passage **136*a* is formed to permit the flow of fresh air passing therethrough into the interior of cap 130. The distributor cap 130 is integrally formed with a cylindrical extension wall 137 which extends into the interior of partition wall 112 of distributor housing 110. The cylindrical extension wall 137 of cap 130 is arranged concentrically with the partition wall 112 to subdivide the interior of partition wall 112 into an annular space Rc and a rotor space Rd. In this arrangement, an inner end 137*a* of the cylindrical extension wall 137 is slightly spaced from the annular rim 123 of rotor flange 121 to form an annular passage i for communication between the annular and rotor spaces Rc and Rd. The annular passage i is further communicated with the annular passage h through an annular passage j around the annular rim 120 of rotor flange 121. Thus, a labyrinth is formed by the annular passages g, h, i and j between a space around the timing belt 40 and the rotor space Rd. In addition, the annular space Rc is formed larger in radial width than each axial width of annular passage h and i to eliminate the occurrence of turbulence therein. The annular space Rc is in open communication with a through hole in cap 130 which is connected to a source of negative pressure by means of a connecting pipe 138. In addition, a cover 140 is fixed to the leg portion 111 of distributor housing 110 by means of fastening bolts 141 to contain therein the ignition distributor assembly Da, driven pulley 30 and timing belt 40**.

In operation, the camshaft 20 is driven by the crankshaft of the engine E through the timing belt 40 to rotate the rotor 120, and in turn, the distributor terminal plate **124*a* rotating in unison with the rotor 120 applies a high voltage produced by an ignition coil at the rhythm of the ignition sequence to the circumferential electrodes 135 from the center electrode 133. During rotation of the rotor 120, the ribs 124*b* of rotor 120 causes the air in rotor space Rd to flow radially outwardly toward the annular passage i and causes suction of the fresh air into the rotor space Rd from the inlet plug 136. In this instance, the vent passage 136*a* of inlet plug 136 permit only the fresh air passing therethrough into the rotor space Rd. On the other hand, rotation of the rotor flange 121 causes the air in the timing belt space to flow into the annular space Rc through the annular passages g, h and j. Thus, the air from rotor space Rd is mixed with the air from the timing belt space in the annular space Rc and is sucked by the negative pressure applied thereto to be discharged out of the annular space Rc through the connecting pipe 138**.

During rotation of the camshaft 20 described above, ozone gas will occur in the rotor space Rd due to the arc formation during the interruption of the high voltage current, and dust particles will occur in the timing belt space due defacement of the timing belt 40. The ozone gas is, however, conveyed by the radial flow of air in rotor space Rd into the annular space Rc through passage i, while the dust particles are conveyed by the flow of air from the timing belt space into the annular space Rc through passages g, h and j. In this instance, the annular rim 123 of rotor flange 121 acts to separate the flow of ozone gas from the flow of dust particles, and the negative pressure is applied to the ozone gas and dust particles through the connecting pipe 138 to forcibly discharge them out of the annular space Rc. Thus, the timing belt 40 is protected from the ozone gas entering into the timing belt space from the rotor space Rd, while the rotor 120 is protected from the dust particles entering into the rotor space Rd from the timing belt space.

Figure 6:
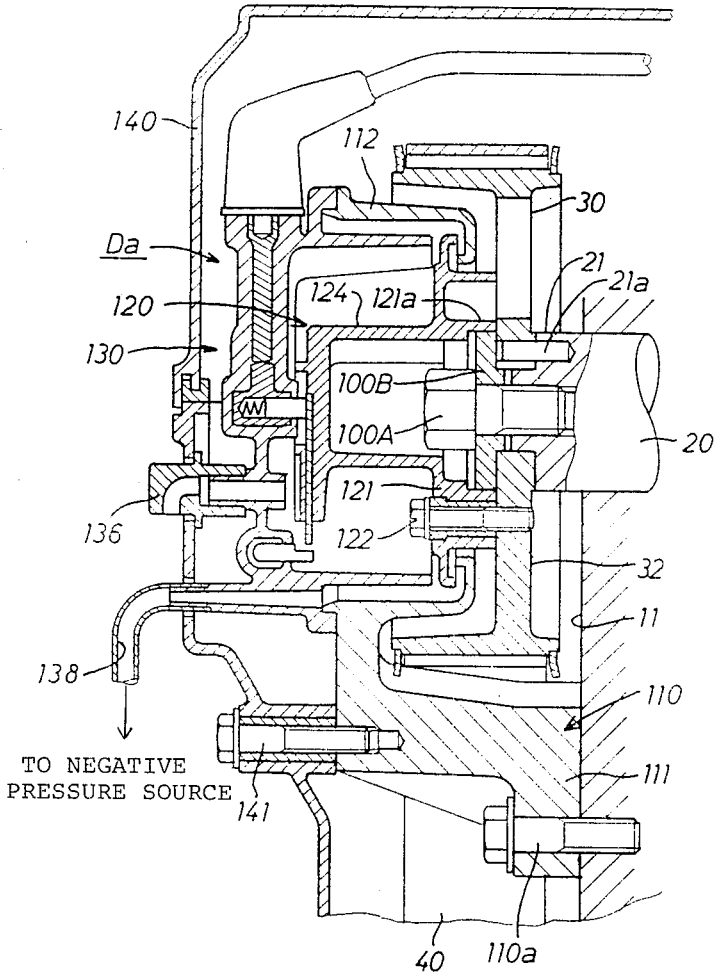
FIG. 6 illustrates a longitudinal section of a modification of the ignition distributor shown in FIG. 4.
Figure 8:
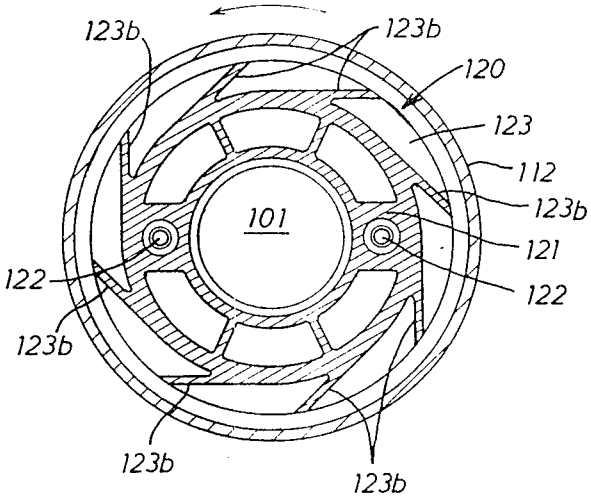
FIG. 8 is a cross-sectional view taken along line F—F in FIG. 7.
Figure 7:
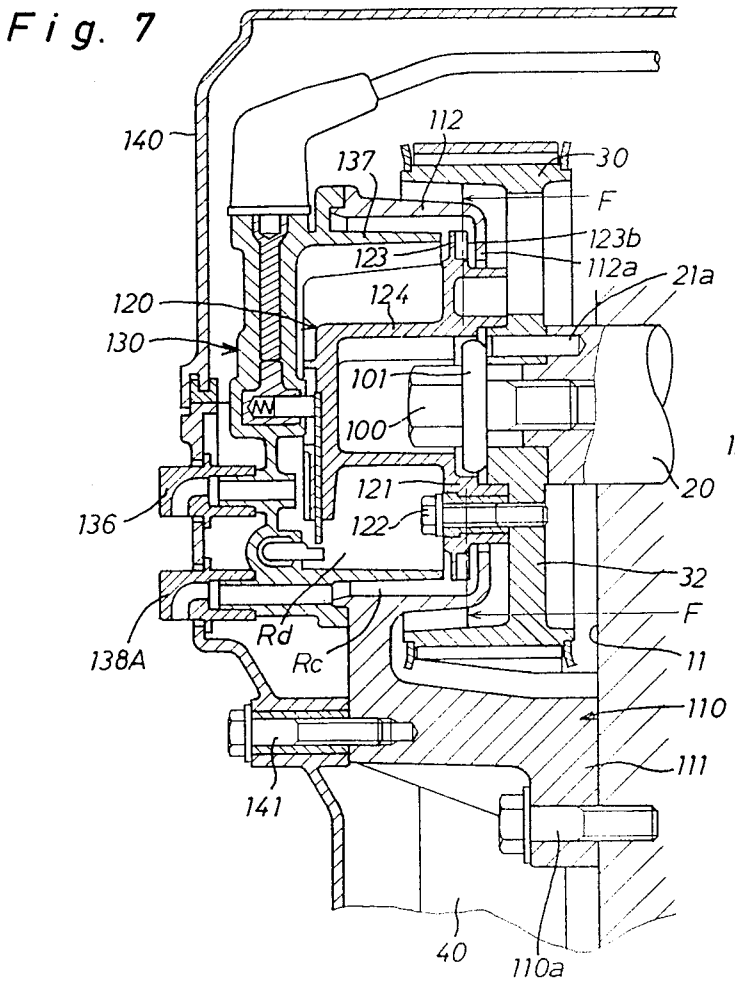
FIG. 7 illustrates a longitudinal section of another modification of the ignition distributor shown in FIG. 4.

In FIG. 6 there is illustrated a modification of the ignition distributor shown in FIGS. 4 and 5, wherein the flanged bolt 100 is replaced with a fastening bolt 100A threaded into the end portion 21 of camshaft 20 through an annular collar 100B. In this modification, the collar 100B is engaged with the hub portion 31 of pulley 30 and coupled within the rotor flange 121 at 121*a*. In FIGS. 7 and 8 there is illustrated another modification of the ignition distributor shown in FIGS. 4 and 5, wherein the rotor flange 121 is integrally formed at its annular rim 123 with a plurality of blades 123*b* which are opposed to the annular bottom portion 112*a* of partition wall 112. During rotation of the camshaft 20, the blades 123*b* of rotor flange 121 act to cause the flow of air from the timing belt space into the annular space Rc so as to forcibly discharge the ozone gas and dust particles out of the annular space Rc. In such a case, the annular space Rc may be communicated with the atmospheric air through an outlet plug 138A mounted on the cover 140.

Having now fully set forth both structure and operation of preferred embodiments of the concept underlying the present invention, various other embodiments as well as certain variations and modifications of the embodiments herein shown and described will obviously occur to those skilled in the art upon becoming familiar with said underlying concept. It is to be understood, therefore, that within the scope of the appended claims, the invention may be practiced otherwise than as specifically set forth herein.

What is claimed is:

1. An ignition distributor for an internal combustion engine having a camshaft rotatably mounted within a cylinder head of the engine and a driven pulley mounted on an end portion of the camshaft extending outwardly from the cylinder head to be driven by a crankshaft of the engine, comprising:

a distributor housing fastened to said cylinder head and having a cup-shaped cylindrical partition wall accomodated in an annular recess of said driven pulley concentrially with a central longitudinal axis of said camshaft, said partition wall having an open end and an annular bottom portion arranged in the annular recess of said driven pulley to provide a circular opening concentric with the central longitudinal axis of said camshaft;

a distributor rotor of generally cylindrical shape fixed to the end portion of said camshaft coaxially therewith and housed in an interior of said partition wall, said rotor having an annular flange formed at its outer periphery with an annular rim which is opposed to the annular bottom portion of said partition wall to form a first annular passage; and a distributor cap coupled with the open end of said partition wall to cover said rotor, said distributor cap having a cylindrical extension wall extending therefrom into the interior of said partition wall and being arranged concentrically with said partition wall to subdivide the interior of said partition wall into an annular space in communication with said first annular passage and a rotor space in which said rotor is arranged, the extension wall of said cap having an inner end spaced from the annular rim of said rotor flange to form a second annular passage for communication between the annular and rotor spaces, wherein the annular space is communicated with a source of negative pressure, and wherein the rotor space is communicated with the atmospheric air.

2. An ignition distributor as claimed in claim 1, wherein the annular space in communication with said first annular passage is communicated with the atmospheric air.

3. An ignition distributor as claimed in claim 1, wherein said distributor housing is integrally formed with a housing fastened to said cylinder head to contain therein said driven pulley.

4. An ignition distributor as claimed in claim 3, wherein the annular space in communication with said first annular passage is communicated with the source of negative pressure through a passage in a side wall of said second-named housing, and wherein the rotor space is communication with the atmospheric air through said distributor cap.

5. An ignition distributor as claimed in claim 1, wherein an adapter is fixed to the end portion of said camshaft coaxially therewith to support said distributor rotor, said adapter having an annular flange concentrically surrounded by an inner periphery of said annular bottom portion of said partition wall to form an annular passage in communication with said first annular passage, and wherein the annular flange of said distributor rotor is fitted to the annular flange of said adapter coaxially therewith and fixed thereto.

6. An ignition distributor as claimed in claim 1, wherein said distributor rotor is integrally formed at an outer periphery thereof with a plurality of circumferentially spaced ribs for causing the air in the rotor space to flow radially outwardly toward said second annular passage during rotation of said camshaft.

7. An ignition distributor as claimed in claim 1, wherein said cylindrical extension wall of said distributor cap is cut out at its periphery in such a manner as to form a plurality of circumferentially spaced openings and to form a plurality of radially inwardly inclined lugs.

8. An ignition distributor as claimed in claim 1, wherein a flanged bolt is threaded into the end portion of said camshaft to fasten the hub portion of said driven pulley in place, and wherein the annular flange of said distributor rotor is coupled over the hub portion of said driven pulley and surrounded by an inner periphery of said annular bottom portion of said partition wall to form an annular passage in communication with said first annular passage.

9. An ignition distributor as claimed in claim 1, wherein a fastening bolt is threaded into the end portion of said camshaft through an annular collar to fasten the hub portion of said driven pulley in place, and wherein the annular flange of said distributor rotor is coupled over said annular collar and surrounded by an inner periphery of said annular bottom portion of said partition wall to form an annular passage in communication with said first annular passage.

10. An ignition distributor as claimed in claim 1, wherein the annular rim of said rotor flange is integrally formed with a plurality of circumferentially spaced blades which are opposed to said annular bottom portion of said partition wall, and wherein the annular space in communication with said first annular passage is communicated with the atmospheric air.

* * * * *